US005205269A

United States Patent [19]

Guzzetta

[11] Patent Number: 5,205,269

[45] Date of Patent: Apr. 27, 1993

[54] TOGGLE LINK POWER CELL BOW

[76] Inventor: Matthew P. Guzzetta, 10425 Loma Rancho Dr., Spring Valley, Calif. 92077

[21] Appl. No.: 582,519

[22] Filed: Sep. 12, 1990

[51] Int. Cl.[5] ..... F41B 5/00

[52] U.S. Cl. ..... 124/25.6; 124/23.1

[58] Field of Search ..... 124/23.1, 24.1, 25.6, 124/88, 900; 267/162

[56] References Cited

U.S. PATENT DOCUMENTS

| | | | |
|---|---|---|---|
| 2,675,225 | 4/1954 | Migny | 267/162 |
| 2,708,110 | 5/1955 | Clay | 267/162 |
| 3,744,473 | 7/1973 | Nishioka . | |
| 3,874,359 | 4/1975 | Cesin . | |
| 3,981,290 | 9/1976 | Islas . | |
| 3,989,026 | 11/1976 | Nishioka | 124/88 X |
| 4,041,927 | 8/1977 | Van House . | |
| 4,103,667 | 8/1978 | Shepley, Jr. | 124/88 X |
| 4,169,456 | 10/1979 | Van House . | |
| 4,201,182 | 5/1980 | Butler | 124/25.6 |
| 4,456,233 | 6/1984 | Müller | 267/162 X |
| 4,458,657 | 7/1984 | Stockmar | 124/25.6 X |
| 4,562,824 | 1/1986 | Jennings | 124/25.6 |
| 4,667,649 | 5/1987 | Humphrey | 124/25.6 |
| 4,756,295 | 7/1988 | Guzzetta . | |
| 4,757,799 | 7/1988 | Bozek | 124/25.6 |
| 4,781,168 | 11/1988 | Lester | 124/25.6 |

FOREIGN PATENT DOCUMENTS

| | | | |
|---|---|---|---|
| 223591 | 12/1942 | Switzerland | 267/162 |

*Primary Examiner*—Randolph A. Reese
*Assistant Examiner*—John A. Ricci
*Attorney, Agent, or Firm*—Frank D. Gilliam

[57] ABSTRACT

A toggle link compound bow includes an elongate riser with limbs pivotally mounted at the ends thereof. The free ends of the limbs are adapted to be connected by a bowstring. A toggle link assembly is connected to an energy storage device and is also coupled to the bow limbs so that as a bowstring connecting the free ends of the limbs is moved to a drawn position, the limbs rotate about their pivot connections and the toggle link assembly moves to cause energy to be stored in the energy storage device. In the illustrated embodiment, the toggle link assembly is connected through separate connecting rods to each of the bow limbs. This allows the energy storage device to be located as desired with respect to the riser to adjust the balance of the bow. The extent of movement of the toggle link assembly in response to movement of the bowstring and limbs is preferably adjustable to easily adjust the draw length of the bow. In a preferred embodiment, an adjusting link is provided in the toggle link assembly to provide the draw length adjustment. The energy storage device may be a spring made up of a plurality of disc springs or Belville washers arranged in face-to-face configuration. The properties of this energy storage device can also be easily adjusted.

15 Claims, 6 Drawing Sheets

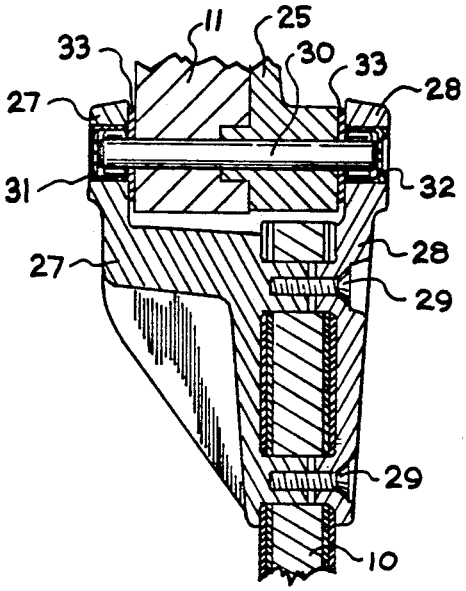
fig. 6
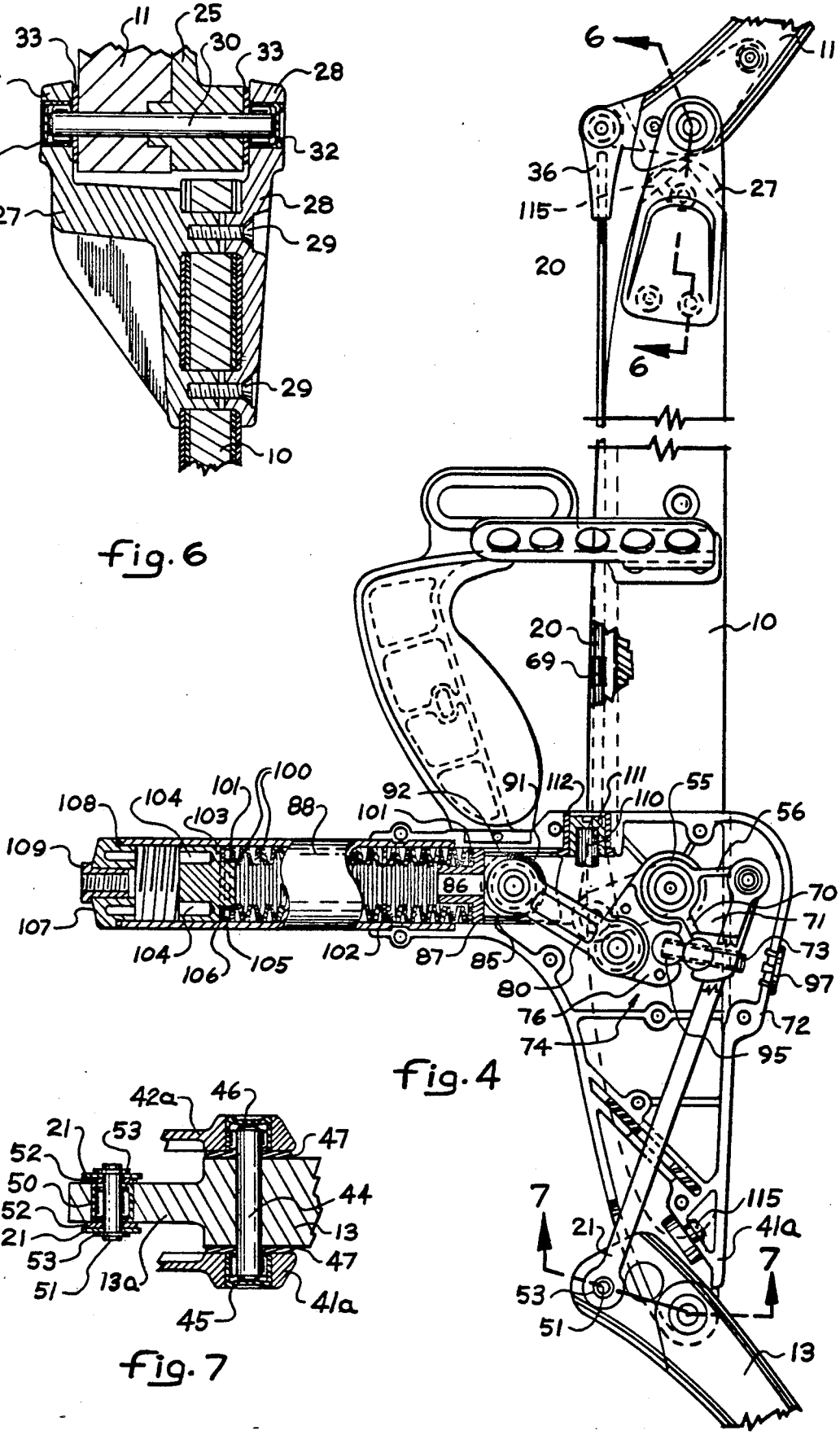
fig. 4
fig. 7

TOGGLE LINK POWER CELL BOW

BACKGROUND OF THE INVENTION

1. Field

The invention is in the field of archery bows wherein the limbs of the bow are pivotally mounted on the handle or riser section of the bow and the principal energy stored in the bow is stored otherwise than through the bending of the limbs.

2. State of the Art

Most archery bows include a handle or riser section with a pair of limbs fixed thereto and extending from opposite ends thereof. A bowstring is coupled to the free ends of the limbs so that upon drawing the bowstring, the limbs are deformed, thereby storing energy in the limbs. Upon release of the bowstring, the deformed limbs forcefully return to their rest positions, releasing the stored energy to the bowstring and an arrow nocked thereon. Such bows are normally designed to have a certain draw length, draw weight, and, with compound bows, a certain let-off. Adjustment of the draw length and draw weight of the bow can usually be made within certain ranges by changing the length of the bowstring or the attachment of the limbs to the handle, or, with compound type archery bows, by also adjusting the length of the buss cables and the size or configuration of the eccentrics. Usually, such adjustment is difficult for the archer to perform himself and the range of adjustment is limited.

Various attempts have been made to increase the efficiency of a bow by pivoting the limbs of the bow to the riser section, making the limbs very stiff to minimize deformation, and providing some type of energy storage means, such as a spring, coupled to the bow limbs to store energy as the bow limbs pivot about their mounting to the riser as the bow is drawn. One such bow is shown in my U.S. Pat. No. 4,756,295 issued Jul. 12, 1988. With the bow shown in U.S. Pat. No. 4,756,295, I have discovered that not only can a very efficient bow be provided, but that the arrangement of the energy storage means and its coupling to the bow limbs allows production of a bow that is very easy for the archer to adjust over a very wide range of draw weights and let-offs, without substantially affecting other characteristics of the bow such as bow balance, weight distribution, and feel. Some adjustment of the draw length is also easily obtained, but with such bow, draw length adjustment usually requires changing one of the toggle links or the bow limbs, or both.

The bow of U.S. Pat. No. 4,756,295 includes a power cell or energy storage device coupled directly to one of the pivotally mounted bow limbs and means connecting the two bow limbs together so that they move in unison. The coupling of the power cell directly to one of the bow limbs generally requires that the power cell be located immediately adjacent the mounting of such limb, i.e. at one end of the riser section, usually at the lower end of such riser.

Most archery bows in use today are constructed so that the center of mass substantially coincides with the pivot point of the bow around the thumb when held in shooting position. This minimizes the torque on the bow during shooting of the bow and minimize the force the archer has to apply to counteract such torque and keep the bow level and steady during shooting. The placement of the power cell at the end of the riser as in the bow of my aforesaid patent undesireably limits the flexibility in design of the bow. Because the power cell is located at the end of the riser, the bow has to be designed about the power cell to ensure the proper balance. This usually means that the riser will be short, approximately eighteen inches for a preferred, balanced bow made according to the referenced patent. However, with a riser length of only eighteen inches, and with normal limb lengths, such a bow is shorter in overall length than most archery bows. This means that at a normal draw length of between twenty-eight and thirty inches, the angle of the string at the nocking point of the arrow, where the string is held by the archer, may be such as to pinch the archers fingers. Using a string release mechanism, many of which are commercially available, eliminates this problem, but in many cases it may be desireable to increase the length of the riser. If the power cell remains at the end of the riser, with a longer riser the mass of the power cell undesireably shifts the center of mass from the desired point and requires that the archer get use to and counteract the resultant torque during shooting.

SUMMARY OF THE INVENTION

According to the invention, the energy storage means and associated toggle link assembly are independently located on the riser in desired position independently of the limbs of the bow. In this way, a bow may be designed and constructed to have any desired riser length and the power cell may be positioned along the riser independently of the end of the riser to provide the desired balance with the center of mass substantially coincident with the bow's pivot point, or may be designed and constructed to have any other desired balance characteristic.

The basic bow of the invention includes an elongate handle or riser having limbs pivotally mounted at the ends thereof. The free ends of the limbs are adapted to be connected by a bowstring. A toggle link assembly is connected to an energy storage means and is also connected through separate connecting means to each of the limbs. In this way, the energy storage means can be located as desired with respect to the riser and does not have to be adjacent to either of the ends of the riser.

The toggle link assembly includes a first toggle link means pivotally mounted on the riser and operatively connected to both limbs by the connecting means so that the limbs move simultaneously in a coordinated manner. A second toggle link means, pivotally coupled to the first toggle link means, is operatively connected between the first toggle link means and the energy storage means so that as the bow is drawn and movement of the bow limbs during drawing causes movement of the first link means, such movement causes movement of the second link means causing energy to be stored in the energy storage means.

In a preferred embodiment of the invention, the energy storage means includes a spring means positioned in a cylinder or power canister between a piston slideably received therein and an end plug. Movement of the second toggle link means during drawing of the bow causes movement of the piston to compress the spring means. Release of the bow string after drawing allows the spring means to expand and force the second and first toggle link means to return the bow limbs and bow string to their rest positions.

It is preferred that an adjustment link be included between the first and second toggle links so that the relative positions of the first and second toggle links can be easily adjusted. Such adjustment changes the draw length of the bow without need to change links or bow limbs.

In one embodiment of the bow, the spring means is made up of a plurality of disc springs or Beville washers placed in side-by-side relationship between the piston and end plug of the power canister. These springs have been found to be very effective energy storage springs. Further, by using such disc springs, springs of various desired energy storage characteristics can be easily and accurately constructed in the canister.

THE DRAWINGS

The best mode presently contemplated for carrying out the invention is illustrated in the accompanying drawings, in which:

FIG. 1, is a side elevation of a bow of the invention, the solid lines showing the bow in undrawn or rest position, the broken lines showing the bow in drawn position;

FIG. 2, a fragmentary front elevation of the bow of FIG. 1, taken on the line 2—2 of FIG. 1 and drawn to a larger scale;

FIG. 3, a fragmentary side elevation of the side of the bow opposite that shown in FIG. 1, taken on the line 3—3 of FIG. 2;

FIG. 4, a fragmentary side elevation similar to that of FIG. 1, taken on the line 4—4 of FIG. 2, but with a cover plate removed and some portions broken away to show interior parts, and showing the bow in undrawn or rest position;

FIG. 5, a fragmentary side elevation similar to that of FIG. 4, but showing the bow in drawn position;

FIG. 6, a fragmentary vertical section taken on the line 6—6 of FIG. 4, showing the mounting of the upper limb and drawn to a larger scale;

FIG. 7, a fragmentary horizontal section taken on the line 7—7 of FIG. 4, showing the mounting of the lower limb and drawn to a larger scale;

FIG. 8, a fragmentary vertical section taken on the line 8—8 of FIG. 5, showing the adjustable arrangement of the first toggle link means and the adjustment link and drawn to a larger scale;

FIG. 9, a vertical section through the energy storage means taken on the line 9—9 of FIG. 5, and drawn to a larger scale;

FIG. 10, a horizontal section through the riser taken on the line 10—10 of FIG. 5, showing the upper limb connecting rod and drawn to a larger scale;

FIG. 11, a fragmentary horizontal section taken on the line 11—11 of FIG. 5, showing the toggle link assembly and drawn to a larger scale;

FIG. 12, a fragmentary horizontal section taken on the line 12—12 of FIG. 3, showing the mounting of the upper limb, and drawn to a larger scale;

FIG. 13, a fragmentary vertical section taken on the line 13—13 of FIG. 5, showing the thrust rollers;

FIG. 14, a perspective view of the preferred toggle link assembly of the invention and the piston of the preferred energy storage means of the invention removed from the bow for illustration purposes; and FIG. 15, an assembly view of the toggle link assembly of FIG. 14.

DETAILED DESCRIPTION OF THE ILLUSTRATED EMBODIMENT

Figure 1:
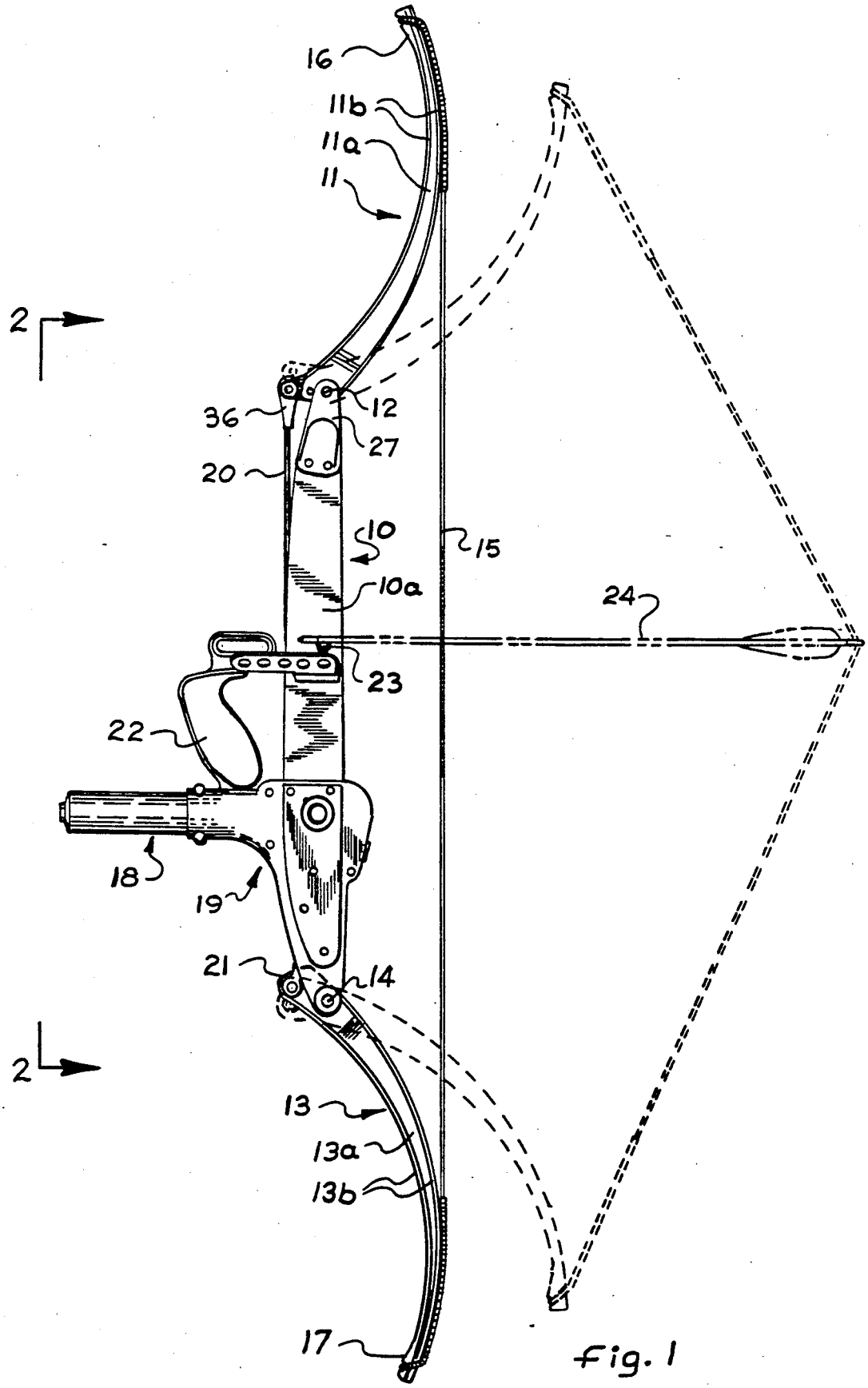

As shown in FIG. 1, the bow of the invention includes a handle or riser 10, with an upper or first limb 11 pivotally mounted at 12 at the top of riser 10 and a lower or second limb 13 pivotally mounted at 14 at the bottom of riser 10. A bow string 15 is secured to the free ends 16 and 17, of upper and lower limbs 11 and 13, respectively, in normal manner. An energy storage means or power cell, generally 18, is coupled through a toggle link assembly, not shown in FIG. 1 but located in toggle link housing position 19 of riser 10, and through connecting rods 20 and 21 to upper and lower limbs 11 and 13, respectively. The toggle link assembly and connecting rods couple the limbs to provide simultaneous, coordinated movement of both limbs.

Figures 5, 9, 10:
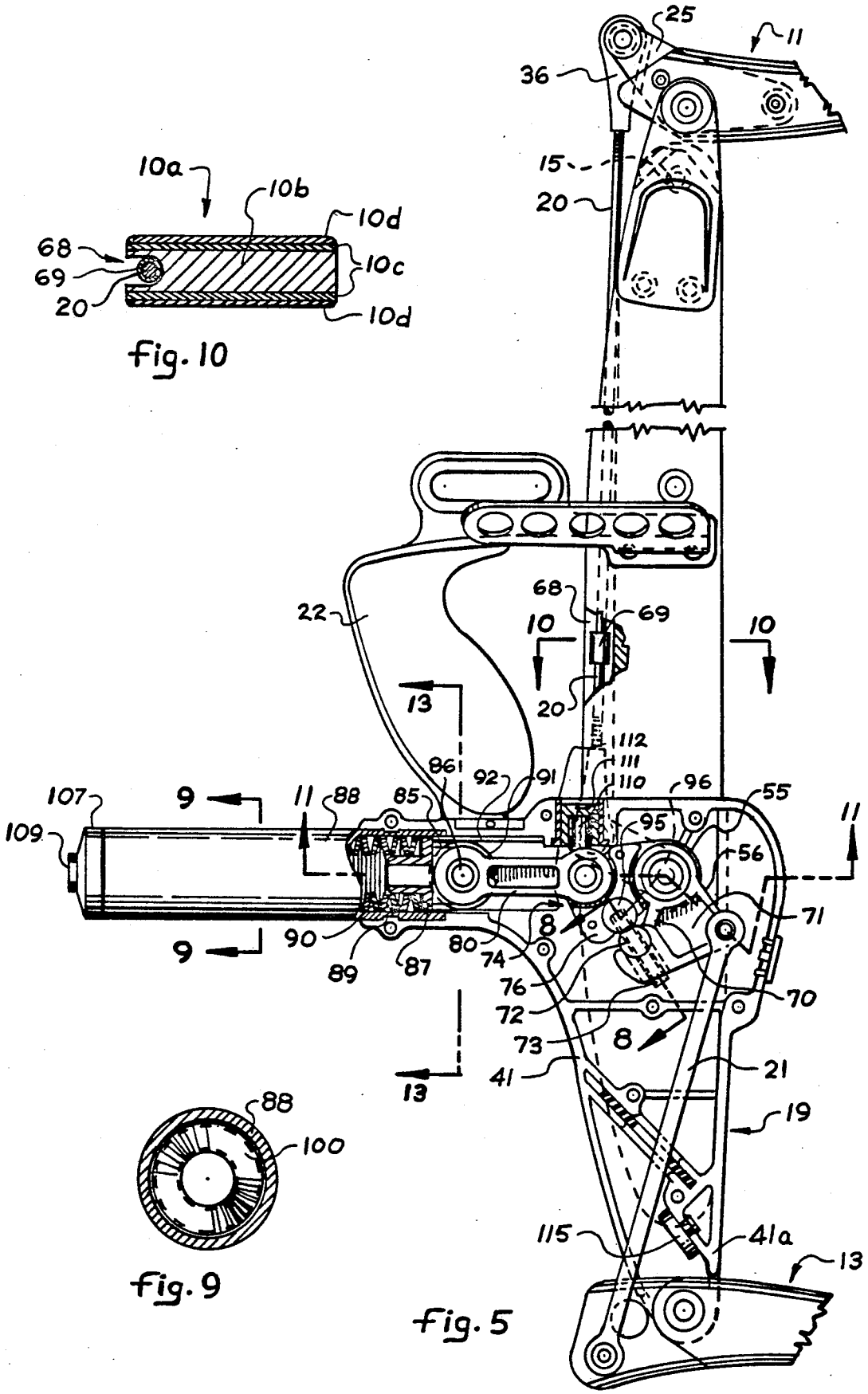

Riser 10 is made up of a side plate **10*a* and housing 19. Side plate 10*a* may be made of various materials using various construction techniques and, for example, may, as shown in FIG. 10, have a core 10*b* of wood or other material with layers 10*c* of carbon fiber reinforced resin with an outer appearance layer 10*d* of wood laminate or other material. Similarly, the bow limbs may be constructed of various materials and using various techniques and, for example, as shown in FIG. 1, may include wood cores 11*a* and 13*a* sandwiched between outer layers of fiberglass reinforced resin 11*b* and 13*b***.

A handle 22 is secured to riser 10 between riser side plate **10*a* and power link housing 19 to be gripped and held by an archer when using the bow. An arrow rest 23 is mounted on handle 22 to support an arrow 24, shown in phanton lines. The solid lines in FIG. 1 show the bow in braced, undrawn, or rest position, while the broken lines shown the bow in its drawn position. It will be noted that in drawn position, limbs 11 and 13 have been pivoted about pivots 12 and 14, respectively, but that the respective limbs 11 and 13 have not themselves been substantially deformed. Most of the energy expended by the archer in drawing the bow has been transferred to and stored in the energy storage means 18. When the archer releases the bowstring from drawn position, the energy storage means releases its stored energy and forcefully causes the bow limbs and bowstring to return to their rest positions, thereby imparting energy to arrow 24**.

Figure 3:
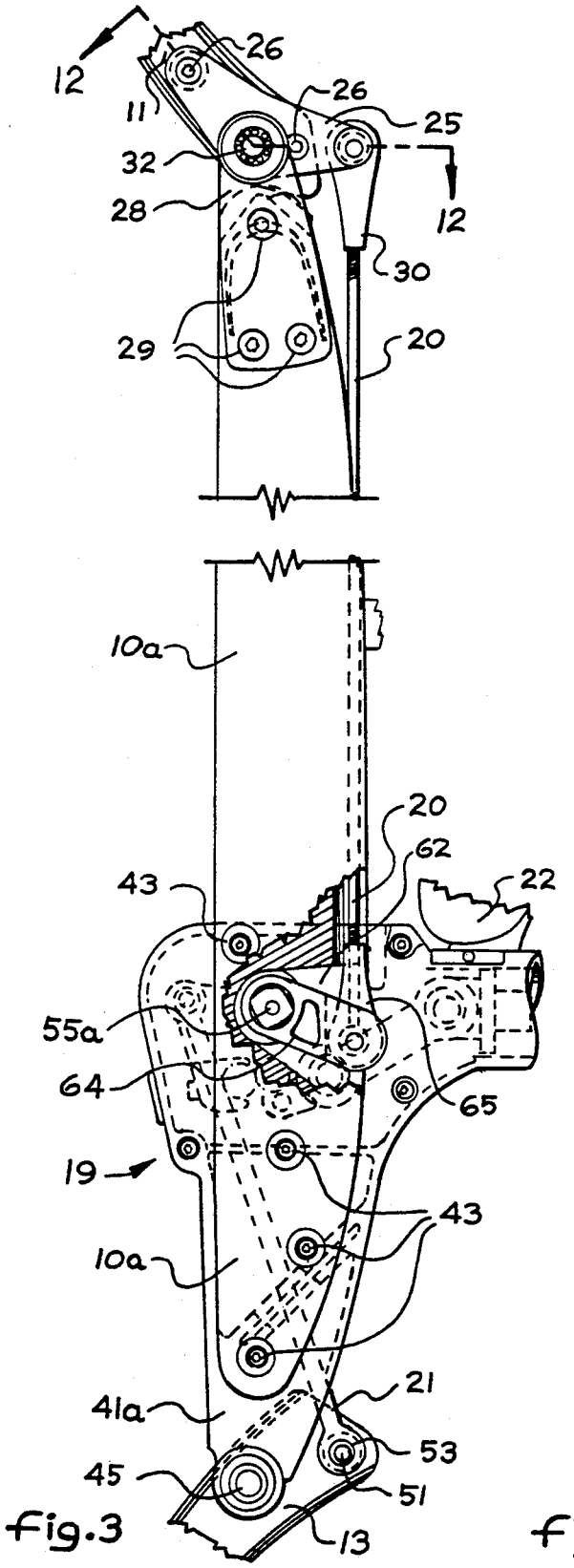
Figure 12:
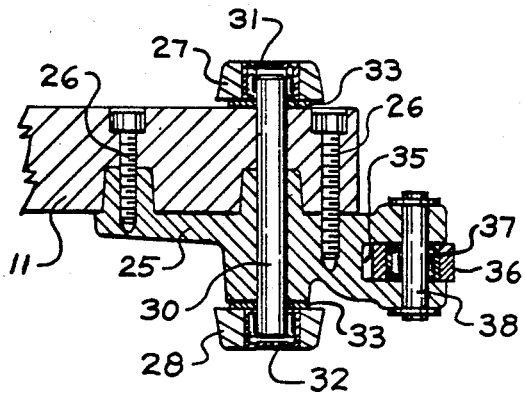
Figure 8:
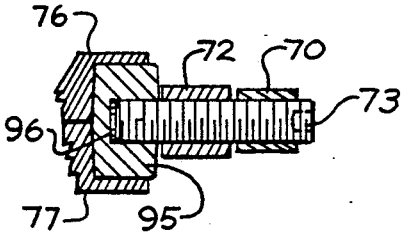
Figure 13:
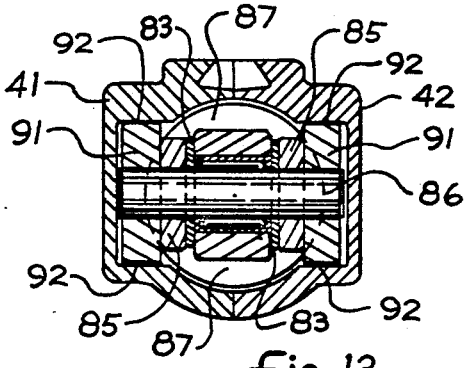

As best shown in FIGS. 2, 3, 4, 6 and 12, the pivotally mounted end of upper bow limb 11 has a power link 25 secured to one side thereof such as by screws 26, FIGS. 3 and 12, which extend through receiving holes in limb 11 and are threaded into power link 25. The heads of screws 26 are countersunk into bow limb 11, as shown. The end of limb 11 with power link 25 is received between mounting plates 27 and 28 secured to the upper end of riser side plate **10*a* as by screws 29, see particularly FIG. 6. A pivot pin 30 extends through limb 11 and power link 25 and has opposite ends received in bearings 31 and 32 mounted in mounting plates 27 and 28, respectively, FIGS. 6 and 12. Washers 33** space the bow limb and power link assembly between the mounting plates.

Power link 25 extends beyond the end of limb 11 and terminates in a receiving slot 35 for pivotally receiving an end fitting 36 threaded onto connecting rod 20. End fitting 36 includes a bearing 37 which receives pivot shaft 38.

Figure 2:
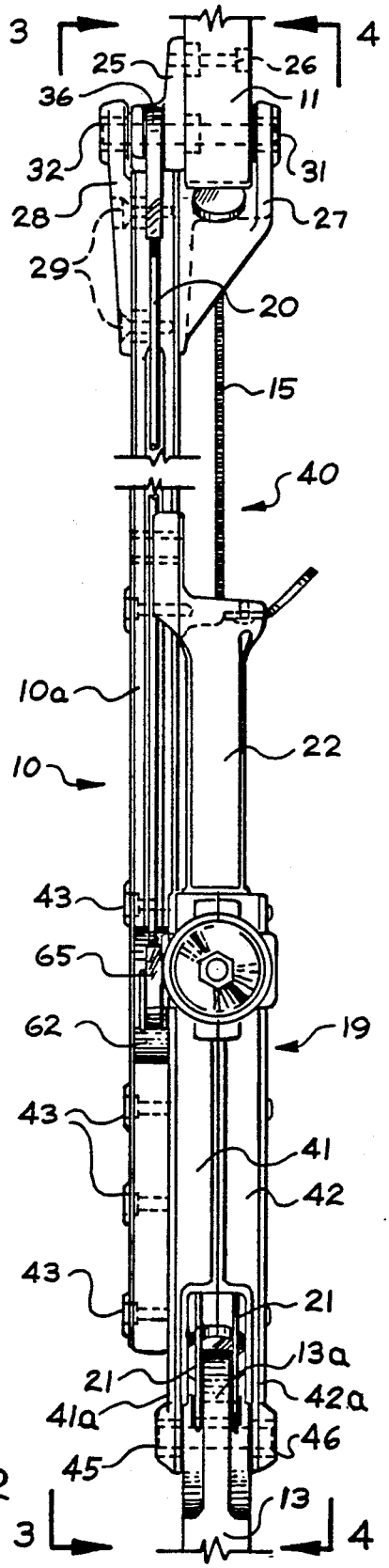

As shown in FIGS. 2 and 6, the arrangement of power link 25 on one side of bow limb 11 and of mounting plate 27 which extends laterally from riser side plate 10*a*, combine to laterally offset limb 11 from the upper end of riser side plate 10*a* and from connecting rod 20. This offset positions bowstring 15, FIG. 2, in alignment with shot window 40 in riser 10.

Lower limb 13 is pivotally mounted at the lower end of riser 10 between extensions 41*a* and 42*a* of toggle link assembly housing halves 41 and 42, FIGS. 2, 3, and 7, which are secured to riser side plate 10*a* by screws 43 extending through riser side plate 10*a* into housing halves 41 and 42. Limb 13 has an opening therethrough to receive a pivot pin 44, FIG. 7, extending between bearings 45 and 46 mounted in housing extensions 41*a* and 42*a*, respectively. Washers 47 space limb 13 between extensions 41*a* and 42*a*.

Limb 13 terminates in a reduced width portion 13*a*, housing a bearing 50 therein which receives a pivot pin 51 therethrough. A pair of connecting rods 21, spaced on opposite sides of limb portion 13*a* by washers 52 are secured on pivot pin 51 by spring clips 53.

The toggle link assembly includes a torque shaft 55 rotatably mounted in housing halves 41 and 42. Torque shaft 55 has a torque arm 56 extending therefrom and integral therewith for pivotal connection to connecting rods 21 extending from lower limb 13. Torque arm 56 terminates in an enlarged end having a bearing 57 therein which receives a pivot pin 58. Pivot pin 58 extends through the ends of connecting rods 21 and is held in place by head 59 on one end and spring clip 60 on the other end. Thus, any movement of limb 13 is coupled through connecting rods 21 to torque arm 56 and cause rotation of torque shaft 55.

End 55*a* of torque shaft 55 extends through bearing 61 in housing half 41 into a recess 62, FIGS. 2, 3, 11, 14, and 15, in riser side plate 10*a*. End 55*a* is keyed to a torque arm 64 which extends from the torque shaft end 55*a* to pivotally connect with an end fitting 65 of connecting rod 20. Washer 63*a* is positioned between torque arm 64 and bearing 61 while washer 63*b* spaces torque shaft 55 with respect to housing half 42. Torque arm 64 terminates in an enlarged, slotted end which receives end fitting 65 therein. Fitting 65 is secured to torque arm 64 by means of pivot pin 66 which passes through bearing 67 in connecting rod end fitting 65. Thus, any rotation of torque shaft 55 causes a rotation of torque arm 64 and movement of upper limb 11, or, conversely, any movement of upper limb 11 will cause rotation of torque arm 64 and torque shaft 55. Since both the upper and lower limbs are coupled to torque shaft 55, as described, the two limbs move simultaneously and the movement of the two limbs is coordinated and each will move in response to movement of the other. Torque arms 56 and 64 will preferably be of relative lengths so that movement of both limbs will be equal. Further, connecting rod 20 may be threaded into end fittings 36 and 65 with opposite handed threads, if desired, so that rotation of connecting rod 20 with respect to end fittings 36 and 65 will lengthen or shorten the overall connecting rod. In this way, the relative positioning of the limbs can be adjusted.

Riser side plate 10*a* is slotted, as at 68, FIGS. 5 and 10, to accept connecting rod 20 as it extends from torque arm 64 to upper limb power link 25. This keeps connecting rod 20 protectively covered in the region of handle 22 and out of contact with a user's hand. It is also preferred to provide a resilient sleeve 69, such as a rubber sleeve, about connecting rod 20 through a portion of its length to reduce whip of the rod and thereby quiet the bow.

Also extending from torque shaft 55 and rotatable therewith is a torque arm 70, FIGS. 4 and 5. Torque arms 56 and 70 are connected by a web 71 to provide additional strength to both arms. The end of torque arm 70 is configured to pivotally receive a cylindrical insert 72 with longitudinal axis parallel to the axis of torque shaft 55. Cylindrical insert 72 includes a threaded transverse bore therethrough to receive a threaded adjustment screw 73.

Torque shaft 55 with torque arms 56, 64, 70 and web 71 form a first toggle link pivotally mounted by shaft 55 to riser 10 by means of housing 19. Upper limb connecting rod 20 and lower limb connecting rods 21 are pivotally connected to this toggle link.

Figure 11:
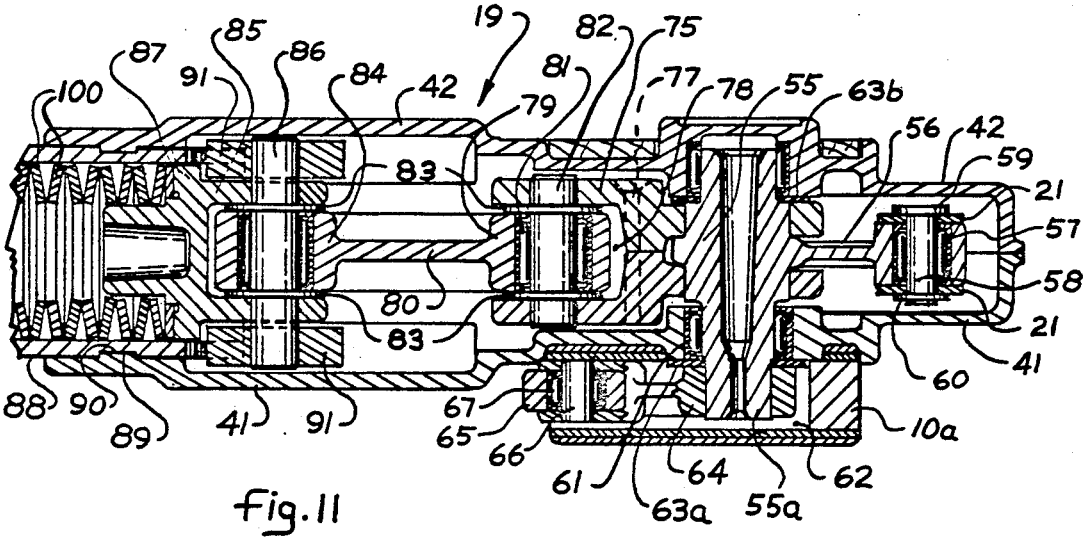
Figures 14, 15:
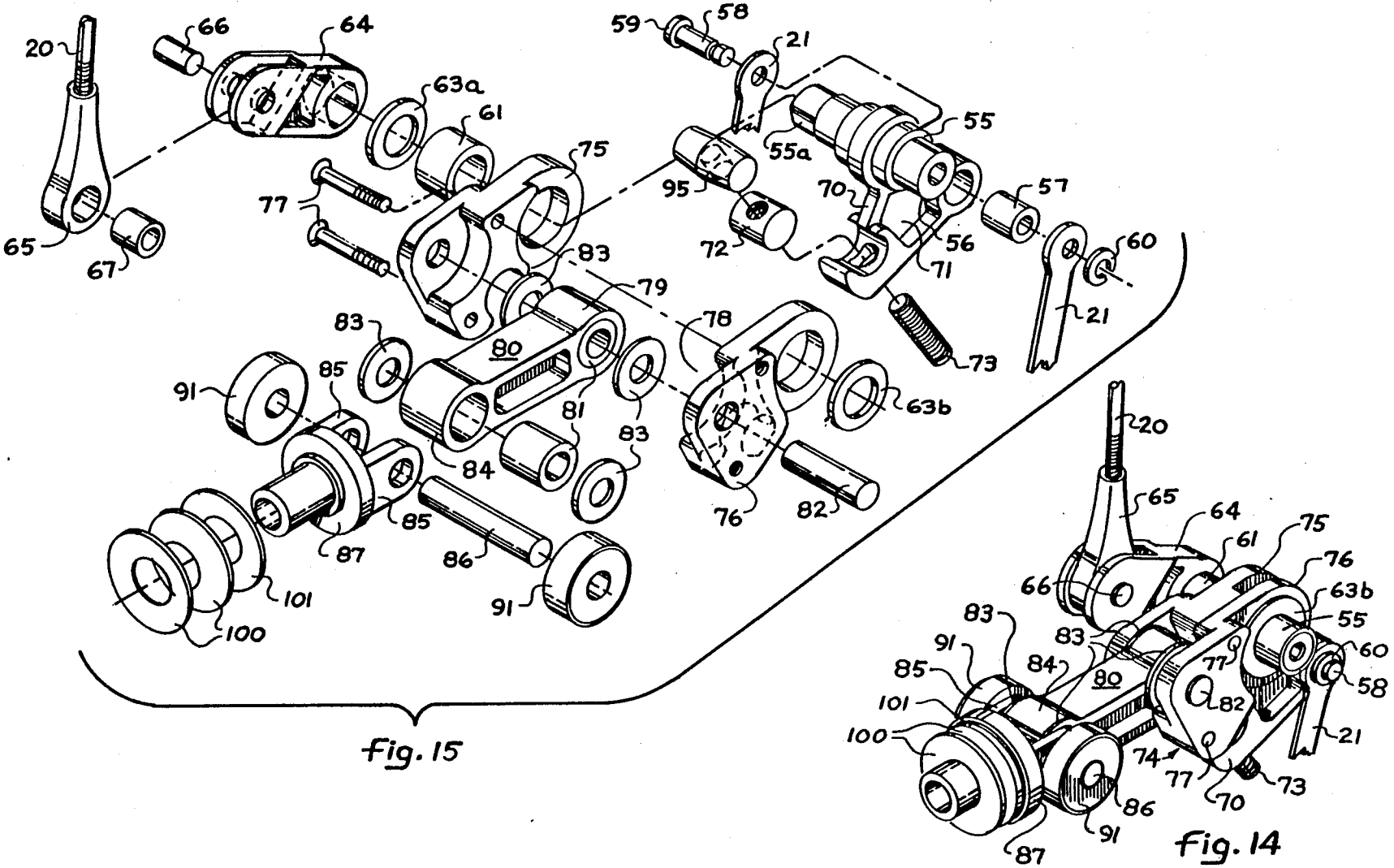

An adjusting link, generally 74, FIGS. 4, 5, and 14, is rotatably received about torque shaft 55 and is formed by adjusting link halves 75 and 76, FIGS. 11, 14, and 15, half 76 shown in FIGS. 4 and 5. Halves 75 and 76 are secured together by screws 77, FIGS. 11, 14, and 15, after being placed about torque shaft 55 from opposite sides to allow torque arms 56 and 70 and web 71 to extend between the rear portions of such halves. When together, the ends of adjusting link halves 70 and 71 opposite the ends about torque shaft 55 form a receiving slot 78 for receiving an end 79 of second toggle link 80. End 79 of second toggle link 80 has a bearing 81 therein and is held in receiving slot 78 by pivot pin 82. Washers 83 space end 79 in the center of receiving slot 78. Independent rotation of adjusting link 74 about torque shaft 55 is limited by the abuting of adjusting link 74 against torque arm 70 of the first toggle link, or adjustment screw 73 extending therefrom.

The opposite end 84 of second toggle link 80 is pivotally secured to the bifurcated end of a piston rod 85 by pivot pin 86. Piston rod 85 extends from a piston 87 slidingly received within a tubular power canister 88 secured to housing 19 by housing annular ring 89, FIGS. 5 and 11, received within canister annular groove 90 when the parts are assembled. Included within power canister 88 is an energy storage means which urges piston 87 toward housing 19. This urges second toggle link 80 in the same direction toward adjusting link 74 which, in the positions of second toggle link 80 and adjusting link 74 shown, tends to rotate adjusting link 74 in a counterclockwise direction about pivot shaft 55 and against the first toggle link. The pivotal movement of second toggle link 80 about pivot pin 86 securing it to piston rod 85 puts an upward (in the position shown in the drawings) pressure on the end of piston rod 85. In order to counteract this pressure and keep piston 87 and piston rod 85 traveling axially with respect to the power canister 88, pivot pin 86 extends outwardly beyond the sides of piston rod 85, FIGS. 11, 14, and 15, and has side thrust rollers 91 rotably mounted thereon. These rollers ride against upper side 92 of the housing, FIGS. 4 and 5, to absorb the upward force applied to the end of piston rod 85 by second toggle link 80.

Rotation of adjusting link 74 in the counterclockwise direction about pivot shaft 55, as shown in FIGS. 4 and 5, is stopped by adjustment screw 73 extending from torque arm 70 or by torque arm 70 itself if the adjustment screw does not extend therefrom. The assembled adjusting link 74 includes a cylindrical insert 95 with a receiving hole 96 therein for receiving and abuting the end of threaded adjustment screw 73. Hole 96 is not threaded. Adjustment screw 73 is freely received therein and can rotate therein. Thus, rotation of adjustment screw 73 to adjust the distance the end of screw 73 extends beyond torque arm 70, adjusts the angular separation and relative positioning of link 74 and torque arm 70, i.e. the relative positioning between the adjusting link 74 and the first toggle link. Since the adjusting link 74 is always urged toward torque arm 70 by means of bow string 15, the end of adjustment screw 73 will remain in receiving hole 96 without being secured thereto. Cylindrical inserts 72 and 95 are free to rotate in torque arm 70 and adjusting link 74, respectively, so that screw 73 remains aligned with receiving hole 96 over the full range of adjustment. It will be realized that as adjusting link 74 is rotated further away from torque arm 70, less rotation of torque shaft 55 and link 74 is required to rotate link 74 from its rest position to its fully rotated position. This means less pivotal movement of the bow limbs and a reduced draw length. Therefore, adjustment of adjustment screw 73 adjusts the draw length of the bow.

As shown in FIG. 4, when the bow is in undrawn or rest position, end 73*a* of adjustment screw 73 is adjacent a side of housing 19. A removeable plug 97 is provided in housing 19 so that, upon removal of plug 97, a tool, such as a hex key, Allen wrench, or screwdriver blade, may be inserted into the end 73*a* of adjustment screw 73 to rotate it. Rotation of the screw will move the screw longitudinally through the threaded opening in cylindrical insert 72 and adjust how far the opposite end of adjustment screw 73 extends toward adjusting link 74. In this manner, the relative positioning between the adjustment link and the first toggle link may be easily adjusted by the archer.

As indicated above, power canister 88 includes energy storage means. Such energy storage means may take various forms. For example, the means may be a coil spring as shown in my earlier U.S. Pat. No. 4,756,295, or an air spring or leaf spring as specifically mentioned in that patent. It has now been found that a very effective energy storage means can be made of a plurality of disc springs 100 positioned together as shown in FIGS. 4, 5, 11, and 15.

As shown, particularly in FIG. 4, a plurality of precision disc springs 100, such as those known as Belville washers available from Bauer Springs Inc. in Pittsburg, Pa., are arranged face-to-face to produce a precision spring within power canister 88. The disc springs are available in various compression weights or spring constants and such springs of the same or assorted compression weights can be used to provide the desired total compression weight of the assembled spring. With disc springs of differing compression weights, springs can be assembled to provide various compression properties per unit distance of compression. Thus, if relatively light disc springs are includes along with relatively heavy springs, as compression begins, the light springs will compress first at their spring constant giving a certain displacement of the overall spring at that constant and then the heavier springs will compress giving a certain additional displacement of the overall spring at that heavier constant. It will generaly be desireable to provide regular flat washers 101 at the front and back of the spring and such flat washers may be used to separate springs of various strengths as shown by flat washer 102, FIG. 4. To form an elongate compression spring using the disc springs, at least some of the individual springs should be arranged in series, i.e., with opposite orientation, as shown in FIGS. 4 and 5. With disc springs arranged face-to-face with opposite orientation, as shown, the deflections of each disc spring are added to give the total available compression deflction of the series and the force from the spring is equal to the force required to deflect a single disc spring. If some of the disc springs are arranged in parallel, i.e. with the same orientation, the deflection available for the parallel combination is the same as that available for a single one of the springs, but the force required to deflect the parallel combincation is the sum of the force required for each individual spring. Thus, an endless variety of spring properties can be created by various combinations of the individual disc springs.

The disc springs are loaded into power canister 88 in desired arrangement against piston 87, and end plug 103 is threaded into the end of canister 88 until the disc springs are all held together. The plug 103 is rotated with a spanner, not shown, having prongs which fit into receiving holes 104 in the end of the plug. Plug 103 may be tightened to any desired degree to preload or precompress the spring formed in the canister. The preloading of the spring easily adjusts the draw weight of the bow over a wide range of draw weights. It is preferred to include a bearing such as a needle bearing thrust washer 105, known as a Torrington bearing, between a flat washer 106 against the end of the end plug 103 and flat washer 101 to ease turning of the plug during preloading of the spring. A cap 107 with gasket 108 is threaded in the end of canister 88 to keep dirt out. Gasket 108 is preferable resilient such as an O-ring, so that when cap 107 is tightened against it, it tends to keep the cap tightly in place. A threaded insert 109 threaded into cap 107 provides means for securing standard stabilizer weights to the bow, or for securing other weights if necessary for balancing the bow. Cap 107 is knurled for ease of removal.

The toggle link assembly also includes a link stop 110, FIGS. 4 and 5, mounted in stop holder 111 threaded into insert 112 in housing 19. Rotation of holder 111 in insert 112 moves stop 110 to adjust how far the first toggle link and associated adjusting link can rotate. Stop 110 adjusts the maximum rotation of the toggle links and thus, for any setting of adjustment screw 73, sets the maximum amount of pivot of the limbs about the end of the riser. This, in turn, adjusts slightly the draw length of the bow. However, the main purpose of adjusting stop 110 is to adjust the amount of let off provided by the bow and to prevent locking of the bow in drawn position. As the bowstring is pulled from undrawn or rest position, as shown in FIG. 4, to a drawn position, as shown in FIG. 5, movement of the bow limbs coupled through connecting rods 20 and 21 to the first toggle link's torque arms 56 and 64, cause rotation of the first toggle link about torque shaft 55. Rotation of the first toggle link causes rotation of the adjustment link which moves the end of second toggle link 80 upwardly to, in turn, move piston 85 in power canister 88 to compress the spring therein. As toggle link 80 moves closer to alignment with the axis of the spring, less force is required to hold the toggle in position. This provides a let-off in the force required to hold the bowstring as the bowstring is drawn toward its fully drawn position similar to the let-off obtained by conventional compound bows. The amount of let-off obtained is adjusted by adjusting link stop 110. However, link stop 110 should be set so that it cannot be adjusted to allow second toggle link 80 to reach the fully aligned position.

In fully aligned position the toggle is locked and provides complete let-off. In such locked position, release of the bow string would not result in firing of the bow. This locking is very dangerous because steps have to be taken to then unlock the bow. Such unlocking could result in an uncontrolled and unexpected dry firing of the bow. It has been found advantageous to make stop 110 of a resilient material such as a urethane with a shore valve above seventy and preferably of about ninety. This provides a softer stop at full draw for the archer. A spring mechanism for the stop could also be used.

The typical force draw curves for the bow of the invention are similar to those for prior art compound bows wherein the force required to draw the string increases as the string is drawn from rest position to an intermediate or peak weight position and then decrease to the full draw position so that the force required to hold the bow at fully drawn position is less than the force required to pull the string through its intermediate peak weight position. The difference in force required to hold the string in these two positions is determined by the let-off of the bow.

With the bow of my present invention, the let off can be adjusted as described by adjusting stop 110. Also, the draw length, while affected by the adjustment of stop 110, can be independently adjusted, or compensated for a change in the adjustment of stop 110, by adjustment of adjustment screw 73. Such adjustment changes the relative position of adjusting link 74 with respect to the first toggle link and thereby adjusts the total amount of rotation of the toggle links required to move from rest position to the position wherein rotation is stopped by stop 110 and desired let-off is obtained. This is an advantage over the bow disclosed in my prior patent previously referred to where a replacement toggle link was required to change the draw length, or to compensate for changes in draw length made by adjusting the let-off. An adjusting link positioned between the first and second toggle links as described herein can be used in similar fashion in the bow of my prior patent to provide easy draw length adjustment in that bow, or, the first toggle link in the bow as illustrated in my prior patent may be adjustably and pivotably attached to the power link of one of the limbs to provide, in similar fashion, the draw length adjustment. In the latter instance, the adjustable mounting of the first toggle link to the power link provides a means for adjusting the extent of movement of the toggle link assembly in response to movement of the means coupling the limbs and toggle link assembly in the bow of that patent to enable easy adjustment of the draw length of that bow.

As described above, by adjusting stop 110 and adjusting screw 73, the bow of the invention can be easily adjusted over a wide range of let-off's and a wide range of draw lengths. Adjustment of the preload on the spring in power canister 88 by turning end plug 103 provides an easy way to adjust the draw weight of the bow over a wide range. Further, the spring or the compression properties of the spring in the power canister can be easily changed or modified to change the force draw properties, bow speed, and efficiency of the bow. In one prototype bow, the dimensions of the toggle links and bow limbs were such that the spring movement or displacement of the spring to the string movement during draw was about 1:30 which resulted in a spring compression of about three-quarters of an inch for a thirty inch draw (actual distance of draw is less than thirty inches since the thirty inches includes the brace height of the bow in undrawn position). With such bow, about 1900 pounds force was exerted on the piston by the spring in the power canister to provide the equivelent of a sixty pound bow. With the use of disc springs, it is easy to provide springs to accurately give up to 3000 or more pounds compression force in the required compression distance of about three-quarters of an inch.

The various adjustments of draw length, let-off, and draw weight described above can be easily accomplished by an archer, even in the field, if desired, by merely rotating the various adjustment screws and spring preload plug. Even changing the spring characteristics by changing the spring itself is very easy for an archer to accomplish and can be done in the field. Other adjustments can be made to the bow to vary its force-draw characteristics. These changes must be made by changing parts of the bow such as the limbs and toggle links and are the type of things considered in designing specific bows for commercial production. For example, the angular relationship between the attachment points of the connecting rods to the limbs and to the toggle link can be changed to modify the characteristics of the bow. Also, the relative lengths of the limb link connecting points from the pivot mounting points of the links compared to the toggle link connecting points from the pivot mounting of the toggle link. As this ratio changes, the degrees of rotation of the limbs compared to the degrees of rotation of the toggle link changes. This changes the amount of movement of the piston within the power canister for a given movement of the bow limbs.

The bow of the invention, as shown in FIGS. 4 and 5, also preferably include resilient limb bumpers or stops 115 for both the upper and lower limbs to cushion the limbs in the event of string or limb breakage. In such instance, the string would no longer stop the limbs and hold them in rest position and the limbs would move forceably forward and strike the riser in the area of the bumpers.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A toggle link compound bow comprising:

an elongated riser;

a first limb pivotably connected to one end of said riser and extending therefrom with a free outer end;

a second limb pivotably connected to the other end of said riser and extending therefrom with a free outer end;

the free outer ends of said limbs adapted to have a bowstring fastened therebetween, said bowstring being translatable from a normal rest position to a drawn unrest position;

an energy storage means mounted on the riser;

a toggle link assembly operatively connected to the energy storage means, said toggle link assembly includes a first toggle link means pivotably mounted on the riser and operatively connected to both a first and second connecting means so that movement of the limbs of the bow cause pivoting of the first toggle link means, a second toggle link means pivotably coupled to the first toggle link means through an adjustment link whereby the effective connection of the second link means to the first link means can be changed and operably connected between said first toggle link means and the energy storage means, said first toggle link means is pivotally mounted on the riser by a torque shaft, wherein said adjustment link is independently pivotally mounted about the torque shaft, and additionally including an adjustment means to adjust the relative angular positioning of said first link means and said adjustment link, whereby as the limbs are moved from the rest position to the unrest drawn position, first and second toggle link means move from a first position to a second position causing energy to be stored in said energy storage means;

first connecting means operably connecting the first toggle link means to the first limb; and second connecting means operably connecting the first toggle link means to the second limb;

said toggle link assembly, first connecting means, and second connecting means providing simultaneous, coordinated movement of said first and second limbs, whereby as a bowstring connected between the free outer ends of the limbs is moved from a rest position to a drawn position, said limbs and toggle link assembly cause energy to be stored in said energy storage means, and whereby the energy stored in said energy storage means causes forceful movement of said limbs and bowstring back to the rest position when the bowstring is released.

2. A toggle link compound bow according to claim 1, wherein the change in the effective connection between the first link means and the second link means changes the draw length of the bow.

3. A toggle link compound bow according to claim 1, wherein the first toggle link means includes stop means, and wherein the adjustment link includes stop means adapted to abut the stop means of the first toggle link means to fix one limit of adjustment between the first toggle link means and the adjustment link.

4. A toggle link compound bow according to claim 3 additionally including an adjustment screw extending from one of the respective stop means toward the other stop means so as to abut such other stop means and position it in spaced relation to the one stop means, the extent to which the screw extends from the one stop means being adjustable to thereby adjust the relative positioning of the respective stop means.

5. A toggle link compound bow according to claim 4, wherein the energy storage means includes a cylindrical canister, a piston slidable received in one end of the canister, an end cap secured in the opposite end of the canister, compression means in the canister between the piston and end cap, and wherein the operable connection of the second toggle link means to the energy storage means is a connection to the piston whereby movement of the second toggle sink means during movement of the outer ends of said limbs from said rest position to said unrest drawn position results in movement of the piston within the canister to compress and store energy in the compression means.

6. A toggle link compound bow according to claim 5, wherein the compression means is a plurality of disc springs arranged in face-to-face configuration between the piston and the end plug.

7. A toggle link compound bow according to claim 6, wherein the end plug is adjustably positioned in the end of the canister to adjust the load on the compression means.

8. A toggle link compound bow according to claim 1, wherein adjustable stop means are included to limit movement of the first and second toggle link means in response to drawing of the bow.

9. A toggle link compound bow according to claim 1, wherein the energy storage means includes a cylindrical canister, a piston slideably received in one end of the canister, an end cap secured in the opposite end of the canister, compression means in the canister between the piston and end cap, and wherein the operable connection of the second toggle link means to the energy storage means is a connection to the piston whereby movement of the second toggle link means during movement of the bow limbs from undrawn to drawn positions results in movement of the piston within the canister to compress and store energy in the compression means.

10. A toggle link compound bow according to claim 9, wherein the compression means is a plurality of disc springs arranged in face-to-face configuration between the piston and the end plug.

11. A toggle link compound bow according to claim 10, wherein the end plug is adjustably positioned in the end of the canister to adjust the load on the compression means.

12. A toggle link compound bow comprising:

an elongate riser;

a first limb pivotably connected to one end of the riser and extending therefrom with a free outer end;

a second limb pivotably connected to the other end of the riser and extending therefrom with a free outer end;

the free outer ends of said limbs adapted to have a bowstring fastened therebetween;

an energy storage means mounted on the riser;

a first toggle link means pivotably mounted on the riser;

an adjustment link means pivotably mounted on the first toggle link means so as to be adjustably rotated about its pivotal mounting point;

a second toggle link means pivotably mounted on the adjustment link means and operatively connected between the adjustment link means and the energy storage means whereby adjustment of the adjustment link means changes the relative positions of the first and second toggle link means in relation to one another; and means coupling said limbs and said first toggle link means whereby as a bowstring connected between the free outer ends of the limbs is moved from its rest position to a drawn position, said limbs and toggle link assembly cause energy to be stored in said energy storage means, whereby the energy stored in said energy storage means causes forceful movement of said limbs and bowstring back to the rest position when the bowstring is released, and whereby the relative positions of the first and second toggle link means in relation to one another as adjusted by the adjusting link adjusts the drawlength of the bow.

13. A toggle link compound bow according to claim 12, wherein the first toggle link means is pivotally mounted on the riser by a torque shaft, wherein the adjustment link is independently pivotally mounted about the torque shaft, and additionally including an adjustment means to adjust the relative angular positioning of the first link means and the adjustment link.

14. A toggle link compound bow according to claim 13, wherein the first toggle link means includes stop means, and wherein the adjustment link includes stop means adapted to abut the stop means of the first toggle link means to fix one limit of adjustment between the first toggle link means and the adjustment link.

15. A toggle link compound bow according to claim 14, additionally including an adjustment screw extending from one of the respective stop means toward the other stop means so as to abut such other stop means and position it in spaced relation to the one stop means, the extent to which the screw extends from the one stop means being adjustable to thereby adjust the relative positioning of the respective stop means.

* * * * *